US007696970B2

(12) United States Patent
Yokota

(10) Patent No.: US 7,696,970 B2
(45) Date of Patent: Apr. 13, 2010

(54) DRIVING CIRCUIT, DISPLAY DEVICE, AND DRIVING METHOD FOR THE DISPLAY DEVICE

(75) Inventor: Junya Yokota, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 925 days.

(21) Appl. No.: 11/476,718

(22) Filed: Jun. 29, 2006

(65) Prior Publication Data

US 2007/0018923 A1 Jan. 25, 2007

(30) Foreign Application Priority Data

Jul. 21, 2005 (JP) ..... 2005-210800
Mar. 8, 2006 (JP) ..... 2006-062232

(51) Int. Cl.
*G09G 3/36* (2006.01)

(52) U.S. Cl. ..... 345/96; 345/209

(58) Field of Classification Search ..... 345/87, 345/96, 103, 208, 209
See application file for complete search history.

(56) References Cited

U.S. PATENT DOCUMENTS

2005/0151714 A1 7/2005 Hirama
2006/0012554 A1* 1/2006 Saishu et al. ..... 345/97
2007/0200113 A1* 8/2007 Yamazaki et al. ..... 257/72
2008/0186441 A1* 8/2008 Ohgiichi et al. ..... 349/151

FOREIGN PATENT DOCUMENTS

JP 9-504389 A 4/1997
JP 11-95729 A 4/1999

* cited by examiner

*Primary Examiner*—Ricardo L Osorio
(74) *Attorney, Agent, or Firm*—Sughrue Mion, PLLC

(57) ABSTRACT

A driving circuit according to an embodiment of the invention includes: a switching unit for sequentially switching between a first operation of applying a positive gray-scale voltage to odd-numbered data lines and applying a negative gray-scale voltage to even-numbered data lines and a second operation of applying a negative gray-scale voltage to odd-numbered data lines and applying a positive gray-scale voltage to the even-numbered data lines; a plurality of short-circuit switches for short-circuiting a pair of adjacent odd-numbered data lines and a pair of adjacent even-numbered data lines to produce a plurality of pairs of short-circuited data lines in a switching period between the first operation and the second operation; and a plurality of common node-connected switches corresponding to the plurality of data line pairs and short-circuiting a corresponding one of the data line pairs to a common node.

19 Claims, 8 Drawing Sheets

DRIVING CIRCUIT, DISPLAY DEVICE, AND DRIVING METHOD FOR THE DISPLAY DEVICE

BACKGROUND OF THE INVENTION

1. Field of the Invention

The present invention relates to a driving circuit and a driving method for a display device having plural electrodes such as a liquid crystal display device, and to a display device using the same.

2. Description of Related Art

Along with recent development of advanced visual and information society and widespread of a multi-media system, flat display devices such as a liquid crystal display device have become more and more important. The liquid crystal display devices have been widely used as display devices for portable devices because of advantages of low power consumption, slimness, and lightweight.

The liquid crystal display device includes a liquid crystal panel for displaying an image, and a driving circuit for driving the liquid crystal panel. An active-matrix type liquid crystal panel includes a device substrate, a counter substrate, and a liquid crystal filled in between the two substrates. Scanning lines are formed in a horizontal direction on the device substrate, and data lines are formed in a vertical direction thereon, and pixel electrodes are formed between the scanning lines and the data lines. Active elements such as TFTs (Thin Film Transistors) are formed around intersections between the scanning lines and the data lines. Gate electrodes of the TFTs are connected with scanning lines, source electrodes are connected with data lines, and drain electrodes are connected with the pixel electrodes.

The scanning lines are connected with a scanning line driving circuit, and the data lines are connected with a data line driving circuit. When the scanning line driving circuit sequentially drives the scanning lines, an output voltage of the data line driving circuit is applied to pixel electrodes through the TFTs. On the other hand, a common electrode opposite to the pixel electrode is formed on the counter substrate. The common electrode is applied with an appropriate level of voltage by a common electrode driving circuit. As a result, a voltage corresponding to a potential difference between the pixel electrode and the common electrode is applied to the liquid crystal. The liquid crystal display device changes a voltage level applied to the liquid crystal to change the orientation of liquid crystal grains and transmittance and thus produces gray scales.

In general, a polarity of a voltage applied to pixel electrode from the data line through the TFT (hereinafter referred to as "pixel voltage") is inverted at predetermined intervals in order to prevent deterioration of displayed image quality. To that end, for example, an AC driving method such as a dot-inversion driving method that changes a polarity of the pixel voltage from one pixel to another has been adopted. With such an AC driving method, the pixel electrode is alternately applied with a positive voltage and a negative voltage, so a large amount of power is consumed. As a countermeasure against this, there has disclosed a technique of setting a voltage of a data line to an intermediate level at the time of inverting a polarity to thereby save power consumption (see Japanese Patent Translation Publication No. 9-504389 and Japanese Unexamined Patent Application Publication No. 11-95729, for instance).

Japanese Patent Translation Publication No. 9-504389 discloses a driving circuit where a data line is short-circuited to a common node by a multiplexer upon the polarity inversion, and a potential of the data line is kept at an intermediate level (common electrode potential) by an external storage capacitor connected with the common node. Further, this publication also discloses a driving circuit that dispenses with the external storage capacitor and connects all data lines to a common node by a multiplexer to set the potential of each data line to about an intermediate level in the case of line-inversion driving.

Japanese Unexamined Patent Application Publication No. 11-95729 discloses a driving circuit where adjacent data lines are temporarily short-circuited upon the polarity inversion and their potentials balance each other out and average out to around the intermediate level. Further, this publication also discloses a driving circuit where all data lines are short-circuited and connected with a common electrode voltage source to keep the potentials of all the data lines to the intermediate level.

However, the above driving circuits have the following problems. That is, in the driving circuit as disclosed in Japanese Patent Translation Publication No. 9-504389, a voltage of the data line is set to an intermediate level upon the polarity inversion by means of the external capacitor. This leads to a problem in that an additional external part is required and costs high. Meanwhile, if the external capacitor is not provided, there are on-resistances corresponding to two switches on a path where the data lines are short-circuited, so a time constant increases and it takes much time to set a voltage of the data line to around the intermediate level. As a result, it is impossible to efficiently set the voltage of the data line to the intermediate level, leading to an increase in power consumption. In the case of short-circuiting the data lines, heat is generated from the on-resistances corresponding to the two switches.

Meanwhile, in the driving circuit as disclosed in Japanese Unexamined Patent Application Publication No. 11-95729, a pair of adjacent data lines is short-circuited upon the polarity inversion to average the voltage levels to about the intermediate level. Thus, an average voltage is determined depending on a pixel voltage of a pair of adjacent data lines. Accordingly, an average voltage may vary from one pair of adjacent data lines to another. It is feared that display characteristics deteriorate like variations of the brightness. Further, although an ideal average voltage is a common electrode voltage, in the case of averaging voltage values every data line pair as mentioned above, an average voltage varies depending on individual voltage values of the adjacent data lines, so an average voltage is not always around the common electrode voltage. If the average voltage deviates from the common electrode voltage, a voltage range of a writing voltage is increased, and power consumption increases. This leads to heat generation in the worst case. If adjacent ones of all the data lines are short-circuited through switches and connected with the common electrode voltage source, as many on-resistances as the switches are used, resulting in a problem in that a time constant increases and it takes much time to set the voltage of the data line to the intermediate level.

SUMMARY OF THE INVENTION

According to an aspect of the present invention, a driving circuit for inversion-driving a display panel having a plurality of data lines that supply a gray-scale voltage, includes: a changeover switch for sequentially switching between a first operation of applying a positive gray-scale voltage to a first data line group and applying a negative gray-scale voltage to a second data line group and a second operation of applying a negative gray-scale voltage to the first data line group and applying a positive gray-scale voltage to the second data line group; a plurality of short-circuit switches for short-circuiting data line of the first data line group and data line of the second data line group to produce a plurality of short-circuited data line groups in a switching period between the first operation and the second operation; and a plurality of common node-connected switches corresponding to the plurality of short-circuited data line groups and short-circuiting a corresponding one of the short-circuited data line groups to a common node. With this structure, the polarity inversion occurs between first data line group and second data line group, and short-circuiting occurs between at least one data line of first group and at least one data line of second group. The data line group consists of one data line of first group and at least one data line of second group which are short-circuited each other. Furthermore, short-circuiting occurs every data line group. Thus, voltage values of the data line group can be averaged. Further, there is an on-resistance corresponding to no more than one switch on a path where data lines are short-circuited for averaging of the voltage values. Thus, it is possible to prevent an increase in time constant, to more speedily set the voltage of the data line to an intermediate level, and to suppress heat generated due to the on-resistance of a switch. Further, since each data line group is connected to a common node, voltage values of the data line groups can be averaged.

According to another aspect of the invention, a display device includes: a display panel including a plurality of scanning lines, a plurality of data lines, a plurality of pixels electrodes defined between the plurality of scanning lines and the plurality of data lines, and a common electrode opposite to the pixel electrodes; and the driving circuit. With this structure, each data line group is connected with a common node, whereby voltage values are averaged between the data line groups and deterioration of display characteristics can be suppressed.

According to another aspect of the invention, a driving method for generating a positive gray-scale voltage and a negative gray-scale voltage relative to a reference voltage to inversion-drive a display panel, includes: periodically switching a voltage applied to a data line between the positive gray-scale voltage and the negative gray-scale voltage; short-circuiting a data line applied with the positive gray-scale voltage and a data line applied with the negative gray-scale voltage to produce a plurality of short-circuited data line groups prior to the switching of the voltage applied to the data line; and short-circuiting each of the short-circuited data line groups to a common node by use of common node-connected switches corresponding to the plurality of short-circuited data line groups. With this method, the polarity inversion occurs between first data line group and second data line group, and short-circuiting occurs between at least one data line of first group and at least one data line of second group. The data line group consists of one data line of first group and at least one data line of second group which are short-circuited each other. Furthermore, short-circuiting occurs every data line group. Thus, voltage values can be averaged between the data line groups. Further, there is only an on-resistance corresponding to no more than one switch on a path where data lines are short-circuited for averaging of the voltage values. Thus, it is possible to prevent an increase in time constant, and to more speedily set the voltage of the data line to an intermediate level. Further, since each data line group is connected to a common node, voltage values can be averaged between the data line groups.

In this case, a switch having a low on-resistance may be used as the short-circuit switch, while a switch having a higher on-resistance than the short-circuit switch may be used as the common node-connected switch. The short-circuit switch has a lower on-resistance, making it possible to suppress heat generation due to the on-resistance of a switch upon short-circuiting data lines; a potential difference between the data lines is large. Further, the common node-connected switch is provided for averaging voltage values between the data line groups, and a potential difference between the data line groups is small. Consequently, even if a switch of a higher on-resistance than the short-circuit switch is used as the common node-connected switch, almost no heat is generated due to the on-resistance of the switch.

According to the present invention, it is possible to provide driving circuit and a display device capable of speedily setting a voltage of a data line to an intermediate level, saving power consumption, and suppressing heat generation due to an on-resistance of a switch, and to provide a display device capable of suppressing deterioration of display characteristics.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

First Embodiment

Figure 1:
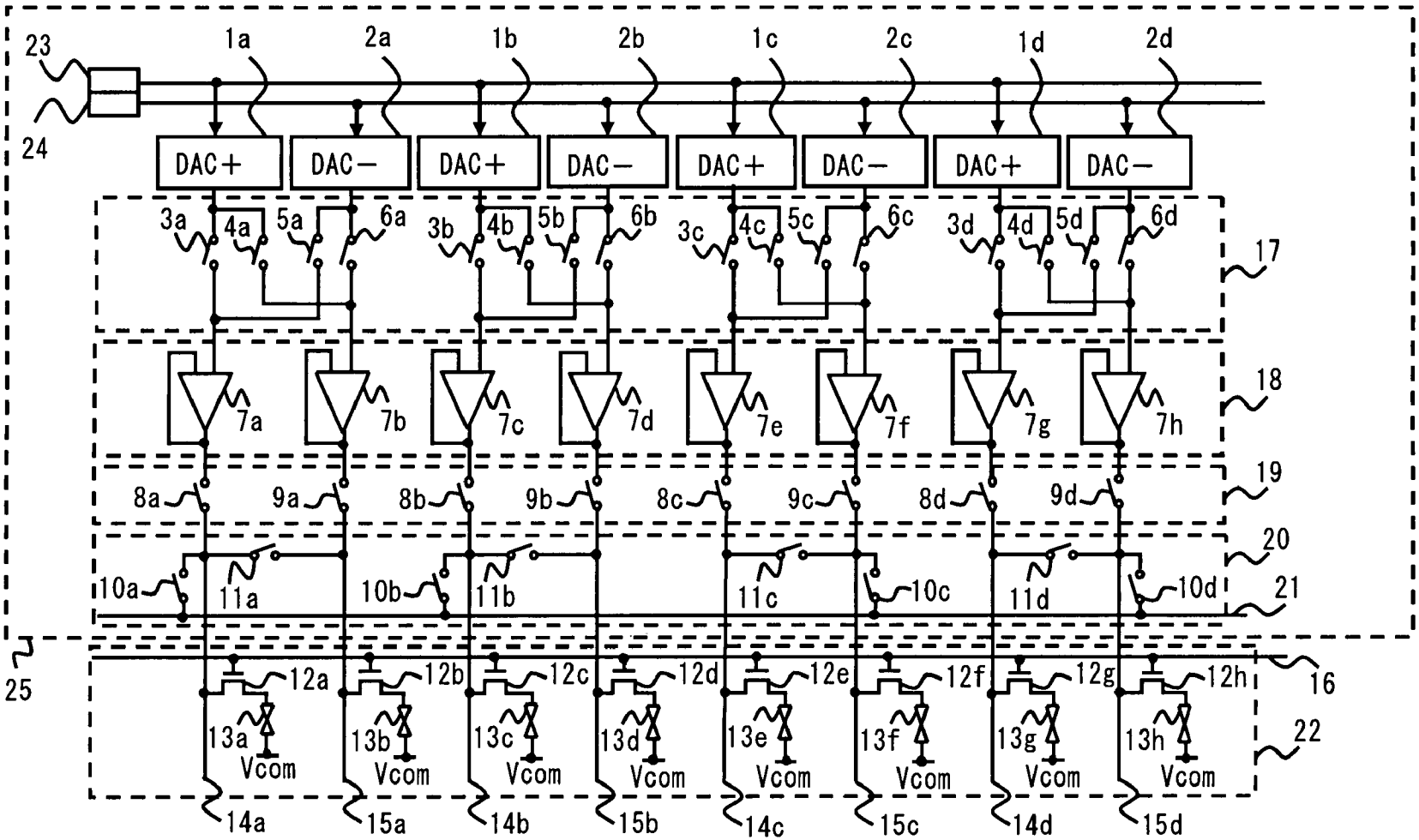
FIG. 1 is a schematic diagram showing the structure of a liquid crystal display device according to a first embodiment of the present invention.

Referring to FIG. 1, a display device according to a first embodiment of the present invention is described. Here, an active matrix type liquid crystal display device is illustrated as an example of the display device. In this embodiment, a dot-inversion driving method is adopted. FIG. 1 is a schematic diagram showing the structure of a liquid crystal display device of this embodiment. The liquid crystal display device of this embodiment includes a liquid crystal panel 22 and a data line driving circuit 25. Incidentally, a scanning line driving circuit for supplying scanning signals, a backlight for applying planar light to the rear side of the liquid crystal panel 22, or the like are omitted from FIG. 1. Further for ease of illustration, FIG. 1 shows 1×8 pixels.

Incidentally, the data line driving circuit 25 may be externally connected to the liquid crystal panel 22; the circuit may be formed on a TFT array substrate connectably with all data lines.

The liquid crystal panel 22 has a display area including plural pixels and displays an image. In the liquid crystal panel 22, a liquid crystal is filled in between a TFT (Thin Film Transistor) array substrate (not shown) and a counter substrate (not shown) opposite thereto. On the TFT array substrate, scanning lines 16 are formed in the horizontal direction, and data lines 14*a* to 14*d* and 15*a* to 15*d* are formed in the vertical direction. Then, TFTs 12*a* to 12*h* are arranged at around intersections between the scanning lines 16 and the data lines 14*a* to 14*d* and 15*a* to 15*d*. In this example, odd-numbered data lines are defined as the data lines 14*a* to 14*d*, and even-numbered data lines are defined as the data lines 15*a* to 15*d*. In addition, a pixel electrode is formed between the scanning line 16 and the data lines 14*a* to 14*d* and 15*a* to 15*d* respectively, that is, plural pixel electrodes are arranged in matrix on the TFT array substrate. Gate electrodes, source electrodes, and drain electrodes of the TFTs are connected to the scanning lines 16, the data lines 14*a* to 14*d* and 15*a* to 15*d*, and the pixel electrodes, respectively.

On the other hand, although not shown in FIG. 1, color filters of R (red), G (green), and B (blue) and a common electrode are formed on the counter substrate. The common electrode is a transparent electrode formed on substantially the entire surface of the counter substrate, in practice. Each scanning line 16 receives a scanning signal, and all of the TFTs 12*a* to 12*h* connected with one scanning line 16 selected based on the scanning signal are concurrently turned on. Then, a gray-scale voltage is applied to each of the data lines 14*a* to 14*d* and 15*a* to 15*d*, and the pixel electrode accumulates charges corresponding to the gray-scale voltage.

An orientation of liquid crystal grains between the pixel electrode applied with the gray-scale voltage and the common electrode is changed in accordance with a potential difference between the pixel electrode and the common electrode. Thus, an amount of light that is incident from a backlight (not shown) and transmitted through the panel is controlled. The pixels of the liquid crystal panel 22 represent a variety of color tones based on a combination of a color gradation corresponding to a light transmission amount and a color of R, G, or B. In the case of displaying a monochrome image, the color filter is unnecessary.

In FIG. 1, 13*a* to 13*f* denote capacitances of liquid crystal filled in between the pixel electrodes and the common electrode. Accordingly, one ends of the liquid crystal capacitances 13*a* to 13*f* are connected with the drain electrode (pixel electrode) of the TFT and the other ends are connected with the common electrode.

This embodiment describes an example where the dot-inversion driving method is adopted. Accordingly, a polarity of a gray-scale voltage applied to the pixel electrode is alternately inverted between the data lines 14*a* to 14*d* and 15*a* to 15*d* and also alternately inverted between the scanning lines 16. A polarity of the gray-scale voltage is switched every frame. Here, the "positive (+)" polarity condition means that a potential of the pixel voltage applied to a data line exceeds a common electrode potential as a reference potential, and the "negative (−)" polarity condition means that a potential of the pixel voltage applied to a data line is lower than a common electrode potential.

A feature of the present invention resides in the data line driving circuit 25. Hereinafter, the data line driving circuit 25 is described in more detail with reference to the accompanying drawings. The data line driving circuit 25 generates the above-mentioned gray-scale voltage in respond to an externally supplied display signal. As well-known in the art, the data line driving circuit 25 includes a shift register circuit and a latch circuit, but these circuits are omitted here. In the case of the above dot-inversion driving, as a display signal supplied to the data line driving circuit 25, a positive-polarity signal and a negative-polarity signal are input. Alternatively, positive- and negative-polarity signals may be a common signal, and the latch circuit may choose which polarity signal to receive.

The data line driving circuit 25 of this embodiment includes a positive gray-scale voltage generating circuit 23, a negative gray-scale voltage generating circuit 24, a positive-polarity DA converter circuits (hereinafter referred to as "positive-polarity DAC") 1*a* told, negative-polarity DA converter circuits (hereinafter referred to as "negative-polarity DAC") 2*a* to 2*d*, a switching unit 17, a buffer unit 18, an output switch unit 19, an output short-circuit unit 20, and a common node 21. The DACs 1*a* to 1*d* and 2*a* to 2*d* are provided on the output side of the gray-scale voltage generating circuits 23 and 24. Further, the switching unit 17 is provided on the output side of the DACs 1*a* to 1*d* and 2*a* to 2*d*, and the buffer unit 18 is provided on the output side of the switching unit 17. The output switch unit 19 is provided on the output side of the buffer unit 18, and the output short-circuit unit 20 is provided on the output side of the output switch unit 19.

The positive gray-scale voltage generating circuit 23 generates and supplies a positive gray-scale voltage to the positive-polarity DACs 1*a* to 1*d*. The negative gray-scale voltage generating circuit 24 generates and supplies a negative gray-scale voltage to the negative-polarity DACs 2*a* to 2*d*.

The positive-polarity DACs 1*a* to 1*d* selects a positive gray-scale voltage corresponding to an externally supplied positive-polarity display signal from among the positive gray-scale voltages supplied by the positive gray-scale voltage generating circuit 23 to supply the selected one to the switching unit 17. The negative-polarity DACs 2*a* to 2*d* selects a negative gray-scale voltage corresponding to an externally supplied negative-polarity display signal from among the negative gray-scale voltages supplied by the negative gray-scale voltage generating circuit 24 to supply the selected one to the switching unit 17. The switching unit 17 turns on/off the switch so as to apply the positive gray-scale voltage from the positive-polarity DACs 1*a* to 1*d* to the odd-numbered data lines 14*a* to 14*d* (first data line group) or the even-numbered data lines 15*a* to 15*d* (second data line group). Further, switching unit 17 turns on/off the switch so as to apply the negative gray-scale voltage from the negative-polarity DACs 2*a* to 2*d* to the odd-numbered data lines 14*a* to 14*d* or the even-numbered data lines 15*a* to 15*d*.

The switching unit 17 includes: first switches 3*a* to 3*d* that are turned on when the gray-scale voltage from the positive-polarity DACs 1*a* to 1*d* is applied to the odd-numbered data lines 14*a* to 14*d*; and second switches 4*a* to 4*d* that are turned on when the gray-scale voltage is applied to the even-numbered data lines 15*a* to 15*d*. The switching unit 17 includes: third switches 5*a* to 5*d* that are turned on when the gray-scale voltage from the negative-polarity DACs 2*a* to 2*d* is applied to the odd-numbered data lines 14*a* to 14*d*; and the fourth switches 6*a* to 6*d* that are turned on when the gray-scale voltage is applied to the even-numbered data lines 15*a* to 15*d*.

The buffer unit 18 outputs the input gray-scale voltages to the output switch unit 19. The buffer unit 18 is provided with buffers 7*a* to 7*h* corresponding to the data lines 14*a* to 14*d* and 15*a* to 15*d*. The output switch unit 19 is provided on the output side of the buffers 7*a* to 7*h*. The output switch unit 19 is provided with output switches 8*a* to 8*d* and 9*a* to 9*d* corresponding to the data lines 14*a* to 14*d* and 15*a* to 15*d*. If the output switches 8*a* to 8*d* and 9*a* to 9*d* are turned on, gray-scale voltages corresponding to display signals are supplied to the data lines 14*a* to 14*d* and 15*a* to 15*d* of the liquid crystal panel 22. Here, odd-numbered output switches corresponding to the odd-numbered data lines 14*a* to 14*d* are denoted by 8*a* to 8*d*, and even-numbered output switches corresponding to the even-numbered data lines 15*a* to 15*d* are denoted by 9*a* to 9*d*.

Further, the output short-circuit unit 20 is provided on the output side of the output switch unit 19. The output short-circuit unit 20 is provided with a short-circuit switch 11 for each pair of the odd-numbered data line 14 and the even-numbered data line 15 that are adjacent to each other. More specifically, a short-circuit switch 11*a* for short-circuiting the first (odd-numbered) data line 14*a* and the second (even-numbered) data line 15*a* is, for instance, provided between these data lines. Further, a short-circuit switch 11*b* for short-circuiting adjacent data lines (third (odd-numbered) data line 14*b* and the fourth (even-numbered) data line 15*b*) is provided between the data lines. Likewise, a short-circuit switch 11*c* is provided between the fifth (odd-numbered) data line 14*c* and the sixth (even-numbered) data line 15*c*, and a short-circuit switch 11*d* is provided between the seventh (odd-numbered) data line 14*d* and the eighth (even-numbered) data line 15*d*.

The output short-circuit unit 20 is provided with common node-connected switches 10*a* to 10*d*. In this embodiment, one end of the common node-connected switch 10*a* is connected with the first data line 14*a*, and the other end is connected with the common node 21. In this example, the common node 21 is formed using continuous wiring, and is in an electrically floating state. Further, one end of the common node-connected switch 10*b* is connected with the third data line 14*b*, and the other end is connected with the common node 21. One end of the common node-connected switch 10*c* is connected with the sixth data line 15*c*, and the other end is connected with the common node 21. Further, one end of the common node-connected switch 10*d* is connected with the eighth data line 15*d*, and the other end is connected with the common node 21. Accordingly, in this embodiment, 8 lines of the first to eighth data lines 14*a* to 14*d* and 15*a* to 15*d* are assumed as one unit, and the two switches 10*a* and 10*b* for short-circuiting the odd-numbered data lines 14 to the common node 21, and the two switches 10*c* and 10*d* for short-circuiting the even-numbered data lines 15 to the common node 21 are provided. That is, the common node-connected switches 10 are provided for pairs of data lines 14 and 15 to establish connection with the common node 21 in one-to-one correspondence. The common node-connected switches 10 are provided for the above data line pairs in one-to-one correspondence; each common node-connected switch 10 is connected with one data line of the data line pair. Accordingly, the data line pair is connected with the common node 21 by a single common node-connected switch 10.

Figure 2:
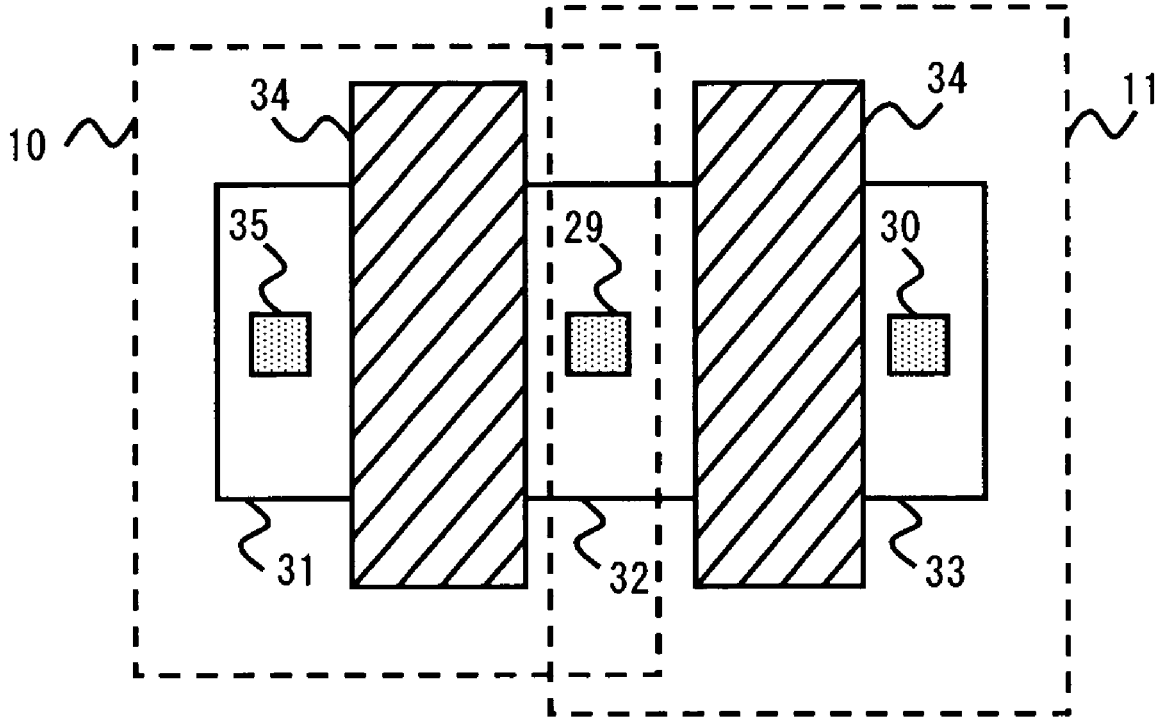
FIG. 2 is a partial schematic diagram showing the structure of a data line driving circuit of the first embodiment.

FIG. 2 shows an example where the common node-connected switches 10 and the short-circuit switches 11 of the output short-circuit unit 20 are MOS transistors. As shown in FIG. 2, the common node-connected switches 10 includes a gate electrode 34, a common node connecting contact 35, a data line connecting contact 29, a drain region 31, and a source region 32. Further, the short-circuit switch 11 includes the gate electrode 34, the data line connecting contacts 29 and 30, the source region 32, and a drain region 33. That is, the common node-connected switches 10 are arranged adjacent to the short-circuit switches 11, and the two switches may share the source region 32. As a result, the common node-connected switches 10 and the short-circuit switches 11 can be laid out in a small area.

Figure 3:
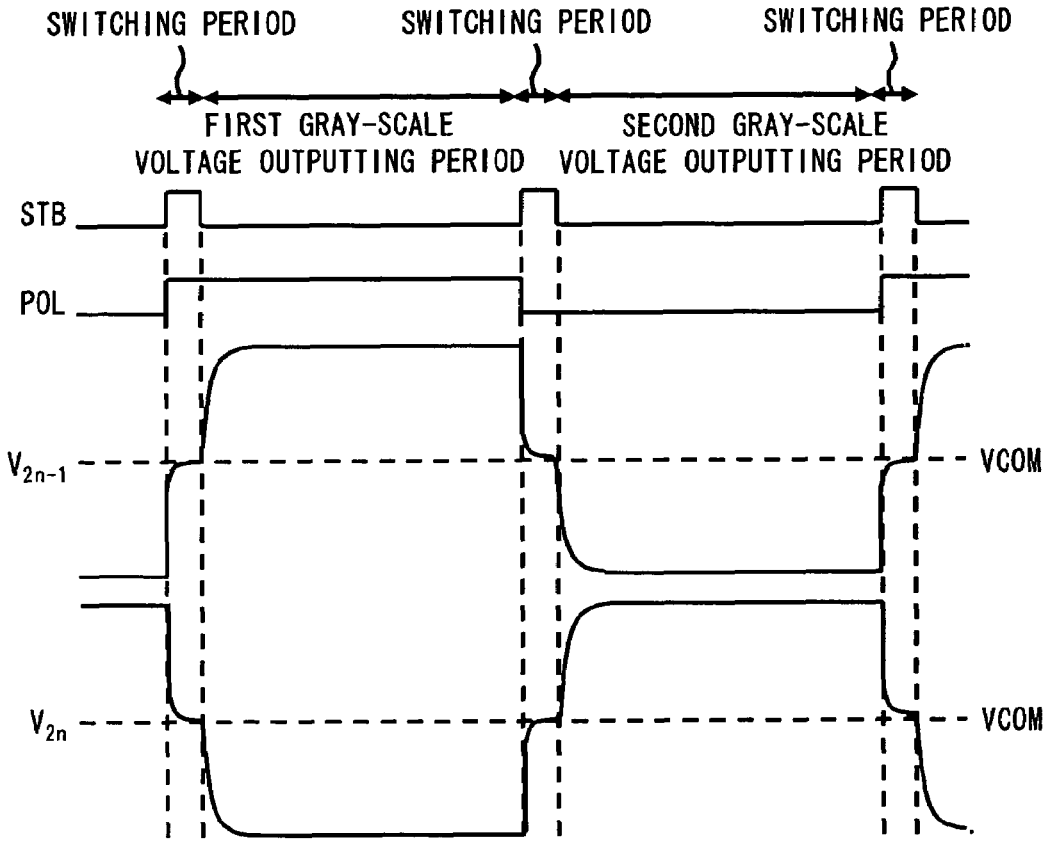
FIG. 3 illustrates an operation of the data line driving circuit of the first embodiment.

Referring now to FIG. 3, an operation of the above data line driving circuit 25 is described. FIG. 3 is a timing chart of an operation of dot-inversion driving the liquid crystal panel 22 using the data line driving circuit 25 of this embodiment. In FIG. 3, the output switches 8*a* to 8*d* and 9*a* to 9*d*, the common node-connected switches 10*a* to 10*d*, and the short-circuit switches 11*a* to 11*d* are controlled based on a signal synchronous with an STB signal. Further, first switches 3*a* to 3*d*, second switches 4*a* to 4*d*, third switches 5*a* to 5*d*, fourth switches 6*a* to 6*d* are controlled based on a signal synchronous with a POL signal for connecting the buffers 7*a* to 7*h* to the positive-polarity DACs 1*a* to 1*d* or negative-polarity DACs 2*a* to 2*d*. Reference symbol $V_{2n-1}$ denotes a waveform of a gray-scale voltage output to the odd-numbered data lines 14*a* to 14*d* (hereinafter referred to as "odd-numbered" output), and $V_{2n}$ denotes a waveform of a gray-scale voltage output to the even-numbered data lines 15*a* to 15*d* (hereinafter referred to "even-numbered" output). Incidentally, in FIG. 3, for ease of illustration, the gray-scale voltages of the same level are applied to the data lines 14*a* to 14*d* and 15*a* to 15*d*.

As shown in FIG. 3, in this embodiment, a gray-scale voltage outputting period for a general display operation (outputting a positive or negative gray-scale voltage) and a switching period for outputting a voltage of an intermediate level (common electrode voltage Vcom) alternately appear. The gray-scale voltage outputting period is divided into a first gray-scale voltage outputting period for supplying a positive gray-scale voltage to the odd-numbered data lines 14*a* to 14*d* and supplying a negative gray-scale voltage to the even-numbered data lines 15*a* to 15*d* and a second gray-scale voltage outputting period for applying a negative gray-scale voltage to the odd-numbered data lines 14*a* to 14*d* and applying a positive gray-scale voltage to the even-numbered data lines 15*a* to 15*d*; the first gray-scale voltage outputting period and the second gray-scale voltage outputting period alternately appear. In addition, a switching period is set between the first gray-scale voltage outputting period and the second gray-scale voltage outputting period. That is, the switching period is set each time the polarity of the output gray-scale voltage is changed. In this case, an STB signal is at a low level in the gray-scale voltage outputting period and at a high level in a switching period.

As shown in FIG. 3, if the POL makes a low to high transition, the first switches 3*a* to 3*d* and the fourth switches 6*a* to 6*d* are turned on, and the second switches 2*a* to 2*d* and the third switches 5*a* to 5*d* are turned off. Thus, the positive-polarity DAC 1*a* is connected with the buffer 7*a*, and the negative-polarity DAC 2*a* is connected with the buffer 7*b*. That is, DACs connected to the odd-numbered data lines 14*a* to 14*d* are switched from the negative-polarity DACs 2*a* to 2*d* to the positive-polarity DACs 1*a* to 1*d*. Further, DACs of the even-numbered data lines 15*a* to 15*d* are switched from the positive-polarity DACs 1*a* to 1*d* to the negative-polarity DACs 2*a* to 2*d*.

If the STB makes a low to high transition on the rising edge of the POL signal, the output switches 8*a* to 8*d* and 9*a* to 9*d* are turned off, and the common node-connected switches 10*a* to 10*d*, and the short-circuit switches 11*a* to 11*d* are turned on. As a result, the buffers 7*a* to 7*h* are disconnected from the data lines 14*a* to 14*d* and 15*a* to 15*d*. Then, the pair of the odd-numbered data line 14 and the even-numbered data line 15 are short-circuited through the short-circuit switch 11. For example, the first data line 14*a* is short-circuited to the second data line 15*a* through the short-circuit switch 11*a*.

Further, the pairs of odd-numbered data lines 14 and even-numbered data line 15 are connected with the common node 21 through the common node-connected switches 10. For example, a pair of the first data line 14*a* and the second data line 15*a* are connected with the common node 21 through the common node-connected switch 10*a* provided to the first data line 14*a*. Thus, all the data lines 14*a* to 14*d* and 15*a* to 15*d* are short-circuited, and their potentials balance each other out and average out to around the intermediate level (voltage Vcom) (switching period).

At this time, the common node-connected switches 10*a* to 10*d* are preferably turned on at a timing later than a timing when the short-circuit switches 11*a* to lid are turned on. The short-circuit switches 11*a* to lid are turned on first, so there is only on-resistance corresponding to one switch on a short-circuit path at the time of averaging voltage values of adjacent data lines. More specifically, in the case of averaging voltage values between data lines a potential difference between which is large like the case of averaging voltage values between the first data line 14*a* with the negative gray-scale voltage and the second data line 15*a* with the positive gray-scale voltage, the voltage values can be averaged using the on-resistance corresponding to one switch of the short-circuit switch 11*a*. Hence, heat generation due to the on-resistance of the switch can be suppressed.

Further, the short-circuit switches 11*a* to 11*d* may be switches having a low on-resistance, and the common node-connected switches 10*a* to 10*d* may be switches having a higher on-resistance than the short-circuit switches 11*a* to 11*d*. If the short-circuit switches 11*a* to 11*d* have a low on-resistance, it is possible to suppress heat generation due to the on-resistance of the switch upon short-circuiting the pair of data lines a potential between which is large. As mentioned above, if the common node-connected switches 10*a* to 10*d* are turned on at a timing later than a timing when the short-circuit switches 11*a* to 11*d* are turned on, the common node-connected switches 10*a* to 10*d* average voltage values between data lines short-circuited by the short-circuit switches 11*a* to 11*d*. Thus, a potential difference of the data line pair is small. Accordingly, even if the common node-connected switches 10*a* to 10*d* have a higher on-resistance than the short-circuit switches 11*a* to 11*d*, almost no heat is generated due to the on-resistance of the switch.

After turning on the short-circuit switches 11*a* to 11*d*, the common node-connected switches 10*a* to 10*d* are turned on, making it possible to average voltage values that vary among data line pairs. To be specific, in the case of averaging voltage values between data line pairs a potential difference between which is small like the case of balancing averaged voltage values between each of the odd-numbered data lines 14*a* to 14*d* and the corresponding even-numbered data lines 15*a* to 15*d*, the data lines 14*a* to 14*d* and 15*a* to 15*d* are connected with the common node 21 through the common node-connected switch 10*a* to 10*d*, and voltage values of all the data lines 14*a* to 14*d* and 15*a* to 15*d* can be averaged. Hence, heat generation due to the on-resistance of the switch can be suppressed.

Next, if the STB signal makes a high to low transition, the output switches 8*a* to 8*d* and 9*a* to 9*d* are turned on, and the common node-connected switches 10*a* to 10*d* and the short-circuit switches 11*a* to 11*d* are turned off. Thus, the buffers 7*a* to 7*h* outputs a gray-scale voltage of a predetermined polarity to the data lines 14*a* to 14*d* and 15*a* to 15*d*. For example, the first data line 14*a* is applied with a gray-scale voltage corresponding to a positive-polarity signal output from the buffer 7*a*. Further, the second data line 15*a* is applied with a gray-scale voltage corresponding to a negative-polarity signal output from the buffer 7*b* (first gray-scale voltage outputting period).

Then, if the POL signal makes a high to low transition, the first switches 3*a* to 3*d* and the fourth switches 6*a* to 6*d* are turned off, and the second switches 4*a* to 4*d* and the third switches 5*a* to 5*d* are turned on. Thus, the DACs connected to the odd-numbered data lines 14*a* to 14*d* are switched from the positive-polarity DACs 2*a* to 2*d* to the negative-polarity DACs 1*a* to 1*d*. Further, the DACs connected with the even-numbered data lines 15*a* to 15*d* are switched from the negative-polarity DACs 1*a* to 1*d* to the positive-polarity DACs 2*a* to 2*d*. For example, the positive-polarity DAC 1*a* is connected with the buffer 7*b*, and the negative-polarity DAC 2*a* is connected with the buffer 7*a*.

If the STB makes a low to high transition on the falling edge of the POL signal, the output switches 8*a* to 8*d* and 9*a* to 9*d* are turned off, and the common node-connected switches 10*a* to 10*d*, and the short-circuit switches 11*a* to 11*d* are turned on. Hence, the buffers 7*a* to 7*h* are disconnected from the data lines 14*a* to 14*d* and 15*a* to 15*d*. Then, pairs of the odd-numbered data lines 14 and the even-numbered data lines 15 are short-circuited through the short-circuit switches 11. For example, the first data line 14*a* is short-circuited to the second data line 15*a* through the short-circuit switch 11*a*.

Further, pairs of the odd-numbered data lines 14 and the even-numbered data lines 15 are connected to the common node 21 through the common node-connected switches 10. For example, a pair of the first data line 14*a* and the second data line 15*a* is connected with the common node 21 through the common node-connected switch 10*a* of the first data line 14*a*. Thus, all the data lines 14*a* to 14*d* and 15*a* to 15*d* are short-circuited, and their potentials balance each other out and average out to around the intermediate level (voltage Vcom) (switching period).

In this example, as mentioned above, the common node-connected switches 10*a* to 10*d* are preferably turned on at a timing later than a timing when the short-circuit switches 11*a* to 11*d* are turned on. Thus, heat generation due to an on-resistance of the switch can be suppressed.

Next, if the STB signal makes a high to low transition, the output switches 8*a* to 8*d* and 9*a* to 9*d* are turned on, and the common node-connected switches 10*a* to 10*d* and the short-circuit switches 11*a* to 11*d* are turned off. At this time, the buffers 7*a* to 7*h* output a gray-scale voltage of a predetermined polarity to the data lines 14*a* to 14*d* and 15*a* to 15*d*. For example, the first data line 14*a* is applied with a gray-scale voltage corresponding to a negative-polarity signal output from the buffer 7*a*. Further, the second data line 15*a* is applied with a gray-scale voltage corresponding to a positive-polarity signal output from the buffer 7*b* (second gray-scale voltage outputting period).

In this way, voltage values of all the data lines 14*a* to 14*d* and 15*a* to 15*d* can be averaged to around an intermediate level each time a polarity of the odd-numbered output signal $V_{2n-1}$ and the even-numbered output signal $V_{2n}$ is switched based on the POL signal. Accordingly, in the case of supplying the gray-scale voltage to the data lines 14*a* to 14*d* and 15*a* to 15*d*, charges may be supplied to change the voltage from the intermediate level to a predetermined gray-scale voltage, and charges supplied to pixel electrodes by the buffers 7*a* to 7*h* are reduced. That is, upon writing the gray-scale voltage, a range of a potential change of the voltage written by the buffers 7*a* to 7*h* can be reduced. Hence, power consumption can be saved upon the dot-inversion driving.

As mentioned above, pairs of the odd-numbered data lines 14*a* to 14*d* and the even-numbered data lines 15*a* to 15*d* are short-circuited by the short-circuit switches 11*a* to 11*d*. Hence, as in a conventional driving circuit, it is possible to prevent an increase in the number of external parts such as an external capacitor. Further, pairs of the odd-numbered data lines 14*a* to 14*d* and the even-numbered data lines 15*a* to 15*d* are connected with the common node 21 through the common node-connected switches 10*a* to 10*d*, and all the data lines 14*a* to 14*d* and 15*a* to 15*d* are short-circuited through the common node 21. Thus, it is possible to prevent deterioration of display characteristics such as variations of the brightness which would occur at the time of averaging voltage values of the pairs of adjacent data lines. Further, each data line pair is short-circuited to the common node 21 by a corresponding one of the common node-connected switches 10*a* to 10*d*, making it possible to prevent an increase in time constant due to the on-resistance of the switch and overcome a problem that it takes much time to set the data line voltage to an intermediate level. Further, the short-circuit switches 11*a* to 11*d* for short-circuiting the data line pairs and the common node-connected switches 10*a* to 10*d* for connecting the lines to the common node 21 are turned on at different timings, making it possible to suppress heat generation.

Incidentally, the switches 11*a* to 11*d* for short-circuiting the data line pair and the common node-connected switches 10*a* to 10*d* for connecting the line to the common node may be short-circuited at the same timing.

Incidentally, in the case of short-circuiting the data lines, charges are moved between the data line with the positive voltage and the data line with the negative voltage such that the positive voltage and the negative voltage cancel out. Here, in the case of the data line having a large wiring capacitance and a large wiring resistance, the voltage does not reach to the intermediate level during the switching period (period in which the STB signal is at high level) in some cases. A charge moving speed is determined based on the time constant $\tau=CR$. Accordingly, it is preferable that an on-resistance of the switch for short-circuiting the odd-numbered data lines 14*a* to 14*d* and the even-numbered data lines 15*a* to 15*d* be small.

Second Embodiment

Figure 4:
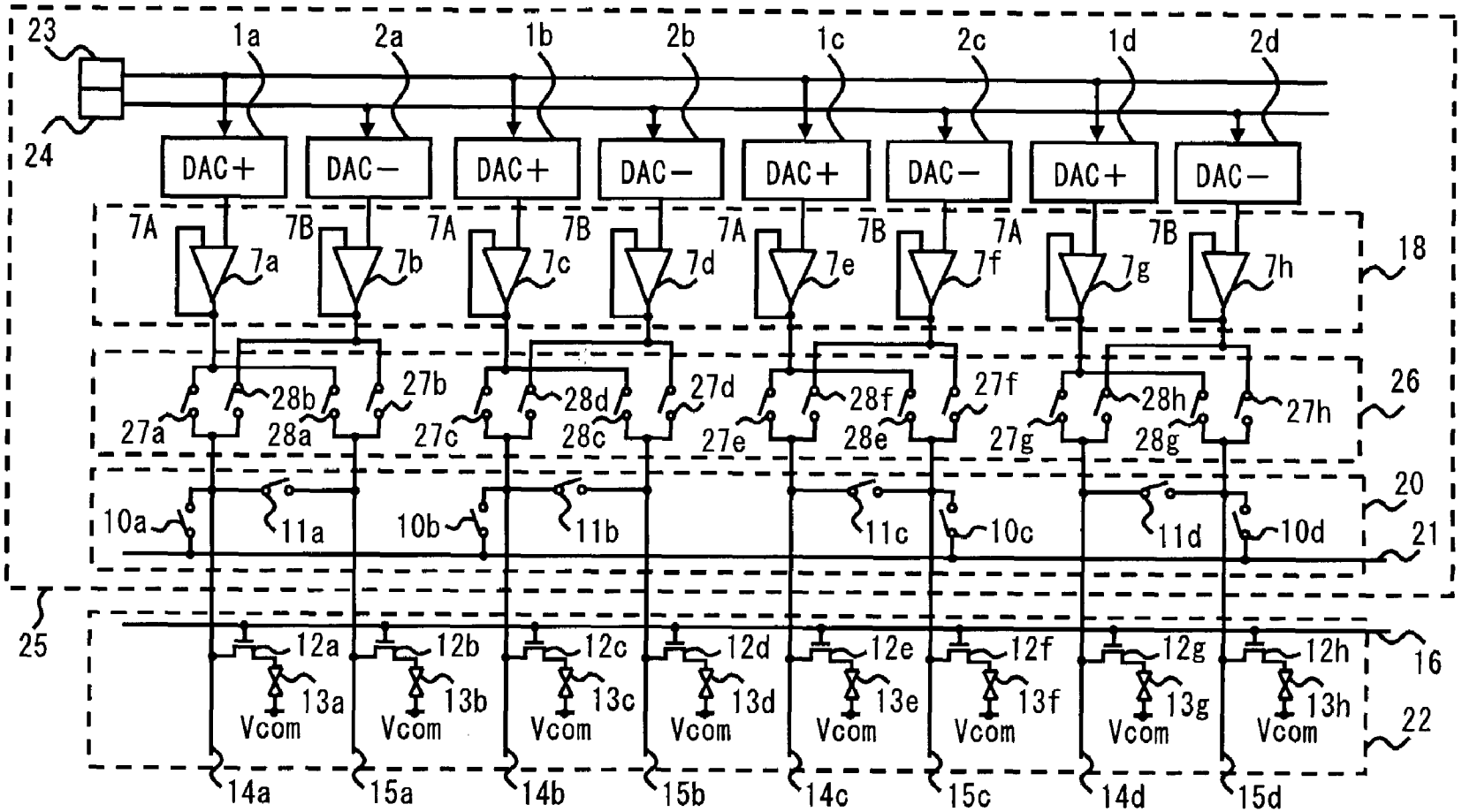
FIG. 4 is a schematic diagram showing the structure of a liquid crystal display device according to a second embodiment of the present invention.

Referring to FIG. 4, a display device according to a second embodiment of the present invention is described. FIG. 4 is a schematic diagram showing the structure of the liquid crystal display device of this embodiment. The liquid crystal display device of this embodiment includes the liquid crystal panel 22 and the data line driving circuit 25. In FIG. 4, the same components as those of FIG. 1 are denoted by identical reference numerals, and repetitive description thereof is omitted here. Incidentally, in FIG. 4, a scanning line driving circuit for supplying scanning signals, a backlight for applying planar light to the rear side of the liquid crystal panel 22, or the like are omitted from FIG. 4. Further for ease of illustration, FIG. 4 shows 1×8 pixels. This embodiment differs from the first embodiment in arrangement of the buffer unit and the switching unit in the data line driving circuit 25. More specifically, the switching unit and the buffer unit are arranged in opposite positions.

Similar to the first embodiment, the data line driving circuit 25 of this embodiment includes the positive gray-scale voltage generating circuit 23, the negative gray-scale voltage generating circuit 24, the positive-polarity DACs 1*a* to 1*d*, the negative-polarity DACs 2*a* to 2*d*, the switching unit 26, the buffer unit 18, the output short-circuit unit 20, and the common node 21. The DACs 1*a* to 1*d* and 2*a* to 2*d* are provided on the output side of the gray-scale voltage generating circuits 23 and 24. Further, the buffer unit 18 is provided on the output side of the DACs 1*a* to 1*d* and 2*a* to 2*d*, and the switching unit 26 is provided on the output side of the buffer unit 18. Further, the output short-circuit unit 20 is provided on the output side of the switching unit 26.

The buffer unit 18 is provided with the buffers 7*a* to 7*h* corresponding to the data lines 14*a* to 14*d* and 15*a* to 15*d*. The buffers 7*a*, 7*c*, 7*e*, and 7*g* are connected with the positive-polarity DACs 1*a* to 1*d*. Accordingly, the buffers 7*a*, 7*c*, 7*e*, and 7*g* are applied with the positive gray-scale voltage. Further, the buffers 7*b*, 7*d*, 7*f*, and 7*h* are connected with the negative-polarity DACs 2*a* to 2*d*. Hence, the buffers 7*b*, 7*d*, 7*f*, and 7*h* are applied with the negative gray-scale voltage. That is, the buffers 7 are divided into buffers for the positive-polarity one and buffers for the negative-polarity one. In this embodiment, for distinguishing between the buffers, the buffers 7*a*, 7*c*, 7*e*, and 7*g* are referred to as positive-polarity buffers 7A, and the buffers 7*b*, 7*d*, 7*f*, and 7*h* are referred to as negative-polarity buffers 7B.

Straight switches 27*a* to 27*h* and cross-switches 28*a* to 28*h* of the switching unit 17 are provided on the output side of the buffers 7*a* to 7*h*. Here, a to h are suffixed to the switches 27 and 28, which are used for supplying the gray-scale voltage output from the buffers 7*a* to 7*h*. For example, the straight switch 27*a* and the cross-switch 28*a* supply the positive gray-scale voltage output from the buffer 7*a*. Further, the straight switch 27*b* and the cross-switch 28*b* supply the negative gray-scale voltage output from the buffer 7*b*.

More specifically, the straight switch 27*a* is turned on when the positive gray-scale voltage from the buffer 7*a* is supplied to the first data line 14*a*. Further, the cross-switch 28*a* is turned on when the positive gray-scale voltage from the buffer 7*a* is supplied to the second data line 15*a*. The straight switch 27*b* is turned on when the negative gray-scale voltage output from the buffer 7*b* is supplied to the second data line 15*a*. The cross-switch 28*b* is turned on when the negative gray-scale voltage from the buffer 7*b* is output to the first data line 14*a*.

The output short-circuit unit 20 is provided on the output side of the switching unit 26. Similar to the first embodiment, the output short-circuit unit 20 is provided with the short-circuit switches 11*a* to 11*d* for each of pairs of the odd-numbered data lines 14 and the even-numbered data lines 15 which are adjacent to each other. More specifically, a short-circuit switch 11*a* for short-circuiting the first (odd-numbered) data line 14*a* and the second (even-numbered) data line 15*a* that are adjacent to each other is provided. Further, the short-circuit switch 11*b* for short-circuiting the third (odd-numbered) data line 14*b* and the fourth (even-numbered) data line 15*b* that are adjacent to each other is provided. The short-circuit switch 11*c* for short-circuiting the fifth (odd-numbered) data line 14*c* and the sixth (even-numbered) data line 15*c* is provided, and the short-circuit switch 11*d* for short-circuiting the seventh (odd-numbered) data line 14*d* and the eighth (even-numbered) data line 15*d* is provided.

Further, the output short-circuit unit 20 is provided with the common node-connected switches 10*a* to 10*d*. In this embodiment, one end of the common node-connected switch 10*a* is connected with the first data line 14*a*, and the other end is connected with the common node 21. Further, one end of the common node-connected switch 10*b* is connected with the third data line 14*b*, and the other end is connected with the common node 21. One end of the common node-connected switch 10*c* is connected with the sixth data line 15*c*, and the other end is connected with the common node 21. Further, one end of the common node-connected switch 10*d* is connected with the eighth data line 15*d*, and the other end is connected with the common node 21. Accordingly, in this embodiment, 8 lines of the first to eighth data lines 14*a* to 14*d* and 15*a* to 15*d* are assumed as one unit, and the two switches 10*a* and 10*b* for short-circuiting the odd-numbered data lines 14 to the common node 21, and the two switches 10*c* and 10*d* for short-circuiting the even-numbered data lines 15 to the common node 21 are provided. That is, the common node-connected switches 10 are provided for pairs of data lines 14 and 15 to establish connection with the common node 21 in one-to-one correspondence.

Figure 5:
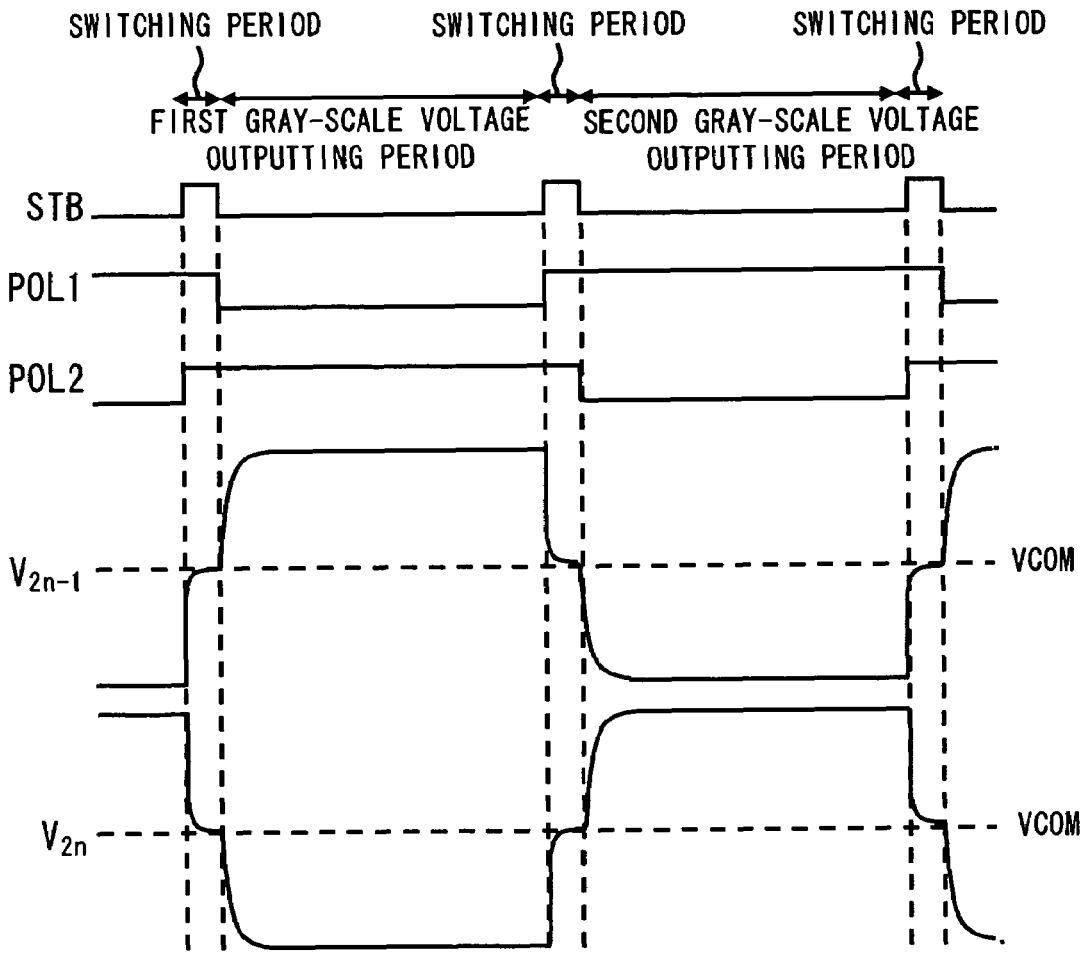
FIG. 5 illustrates an operation of the data line driving circuit of the second embodiment.

Referring now to FIG. 5, an operation of the data line driving circuit 25 of this embodiment is described. FIG. 5 is a timing chart and a data line waveform chart of an operation of dot-inversion driving the liquid crystal panel 22 using the data line driving circuit 25 of this embodiment. The operation of the data line driving circuit 25 of this embodiment is similar to that of the first embodiment; voltage values of the data lines are averaged to an intermediate level each time the polarity of gray-scale voltage supplied to the data line is switched.

The common node-connected switches 10*a* to 10*d* and the short-circuit switches 11*a* to 11*d* are controlled based on a signal synchronous to the STB signal of FIG. 5. Further, straight switches 27 and the cross-switches 28 are controlled based on a signal synchronous to the POL signal so as to switchably apply the gray-scale voltages output from the buffers 7*a* to 7*h* to the odd-numbered data lines 14 and the even-numbered data lines 15. Incidentally, in this embodiment, a POL 1 is a signal for controlling the straight switch 27, and a POL 2 is a signal for controlling the cross-switch 28. In the second embodiment, the output switches 8 and 9 used in the first embodiment are not provided, so it is necessary to set a period for turning off both of the straight switches 27 and the cross-switches 28 for disconnecting the data lines 14 and 15 from the buffers 7. Further, $V_{2n-1}$ denotes a waveform of a gray-scale voltage output to the odd-numbered data lines 14*a* to 14*d*(hereinafter referred to as "dd-numbered output"), and $V_{2n}$ denotes a waveform of a gray-scale voltage output to the even-numbered data lines 15*a* to 15*d* (hereinafter referred to as "even-numbered output"). Incidentally, in FIG. 5, for ease of illustration, the gray-scale voltages of the same level are applied to the data lines 14*a* to 14*d* and 15*a* to 15*d*.

As mentioned above, in this embodiment, similar to the first embodiment, a gray-scale voltage outputting period for a general display operation (outputting a positive or negative gray-scale voltage) and a switching period for outputting a voltage of an intermediate level (common electrode voltage Vcom) alternately appear. The gray-scale voltage outputting period is divided into a first gray-scale voltage outputting period for supplying a positive gray-scale voltage to the odd-numbered data lines 14*a* to 14*d* and supplying a negative gray-scale voltage to the even-numbered data lines 15*a* to 15*d* and a second gray-scale voltage outputting period for applying a negative gray-scale voltage to the odd-numbered data lines 14*a* to 14*d* and applying a positive gray-scale voltage to the even-numbered data lines 15*a* to 15*d*; the first gray-scale voltage outputting period and the second gray-scale voltage outputting period alternately appear. In addition, a switching period is set between the first gray-scale voltage outputting period and the second gray-scale voltage outputting period. That is, the switching period is set each time the polarity of the output gray-scale voltage is changed. In this case, an STB signal is at a low level in the gray-scale voltage outputting period and at a high level in a switching period.

As shown in FIG. 5, if the POL 2 makes a low to high transition, the cross-switches 28 is turned off. Since the straight switches 27 are in an off-state, the straight switches 27 and the cross-switches 28 are both turned off. Thus, the buffers 7*a* to 7*h* are disconnected from the data lines 14*a* to 14*d* and 15*a* to 15*d*.

If the STB makes a low to high transition on the rising edge of the POL 2, the common node-connected switches 10*a* to 10*d*, and the short-circuit switches 11*a* to 11*d* are turned on. As a result, the pairs of odd-numbered data lines 14 and even-numbered data lines 15 are short-circuited through the short-circuit switch 11. For example, the first data line 14*a* is short-circuited to the second data line 15*a* through the short-circuit switch 11*a*.

Further, the pairs of odd-numbered data lines 14 and the even-numbered data lines 15 are connected to the common node 21 through the common node-connected switches 10. For example, the pairs of the first data lines 14*a* and the second data lines 15*a* are connected to the common node 21 through the common node-connected switch 10*a* on the first data line 14*a*. Thus, all the data lines 14*a* to 14*d* and 15*a* to 15*d* are short-circuited and their potentials balance each other out and average out to around the intermediate level (voltage Vcom) (switching period).

Next, if the STB signal makes a high to low transition, the common node-connected switches 10*a* to 10*d* and the short-circuit switches 11*a* to 11*d* are turned off. Further, if the POL 1 makes a high to low transition upon the falling edge of the STB, the straight switches 27 are turned on. At this time, the cross-switches 28 are kept off. Hence, the buffers 7*a* to 7*h* outputs a gray-scale voltage of a predetermined polarity to the data lines 14*a* to 14*d* and 15*a* to 15*d*. For example, the first data line 14*a* is applied with a gray-scale voltage corresponding to a positive-polarity signal output from the buffer 7*a*. Further, the second data line 15*a* is applied with a gray-scale voltage corresponding to a negative-polarity signal output from the buffer 7*b* (first gray-scale voltage outputting period).

Then, if the POL 1 makes a low to high transition, the straight switches 27 are turned off. At this time, the cross-switches 28 are kept off. Thus, the buffers 7*a* to 7*h* are disconnected from the data lines 14*a* to 14*d* and 15*a* to 15*d*. If the STB makes a low to high transition upon the rising edge of the POL 1, the common node-connected switches 10*a* to 10*d*, and the short-circuit switches 11*a* to 11*d* are turned on. Thus, the pairs of odd-numbered data lines 14 and even-numbered data line 15 are short-circuited through the short-circuit switches 11. For example, the first data line 14*a* is short-circuited to the second data line 15*a* through the short-circuit switch 11*a*.

The pairs of odd-numbered data lines 14 and even-numbered data lines 15 are connected to the common node 21 through the common node-connected switches 10. For example, the pair of first data line 14*a* and second data line 15*a* is connected with the common node 21 through the common node-connected switch 10*a* of the first data line 14*a*. Hence, all the data lines 14*a* to 14*d* and 15*a* to 15*d* are short-circuited, and their potentials balance each other out and average out to around the intermediate level (voltage Vcom) (switching period).

Next, if the STB signal makes a high to low transition, common node-connected switches 10*a* to 10*d*, the short-circuit switches 11*a* to 11*d* are turned off. If the POL 2 makes a high to low transition upon the falling edge of the STB, the cross-switches 28 are turned on. At this time, the straight switches 27 are kept off. Thus, the buffers 7*a* to 7*h* output the gray-scale voltage of a predetermined polarity to the data lines 14*a* to 14*d* and 15*a* to 15*d*. For example, the first data line 14*a* is applied with a gray-scale voltage corresponding to the negative-polarity signal output from the buffer 7*b*. Further, the second data line 15*a* is applied with the gray-scale voltage corresponding to a positive-polarity signal output from the buffer 7*a* (second gray-scale voltage outputting period).

In this way, with the structure of the second embodiment, similar to the beneficial effects of the first embodiment, it is possible to save power consumption, prevent deterioration of display characteristics, and shorten a period necessary for setting the voltage to an intermediate level. In addition thereto, the buffers 7 can be used for the positive-polarity one and the negative-polarity one, whereby an output range of the buffers 7 can be narrowed, and an area of the buffers 7 can be reduced.

Figure 6:
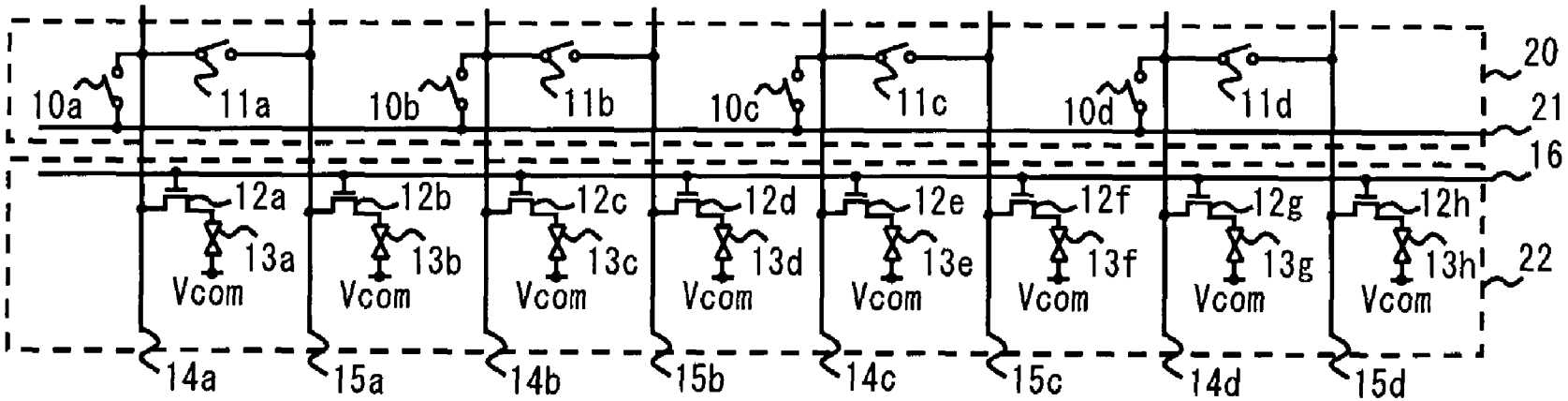
FIG. 6 shows another structure of the data line driving circuit according to the present invention.
Figure 7:
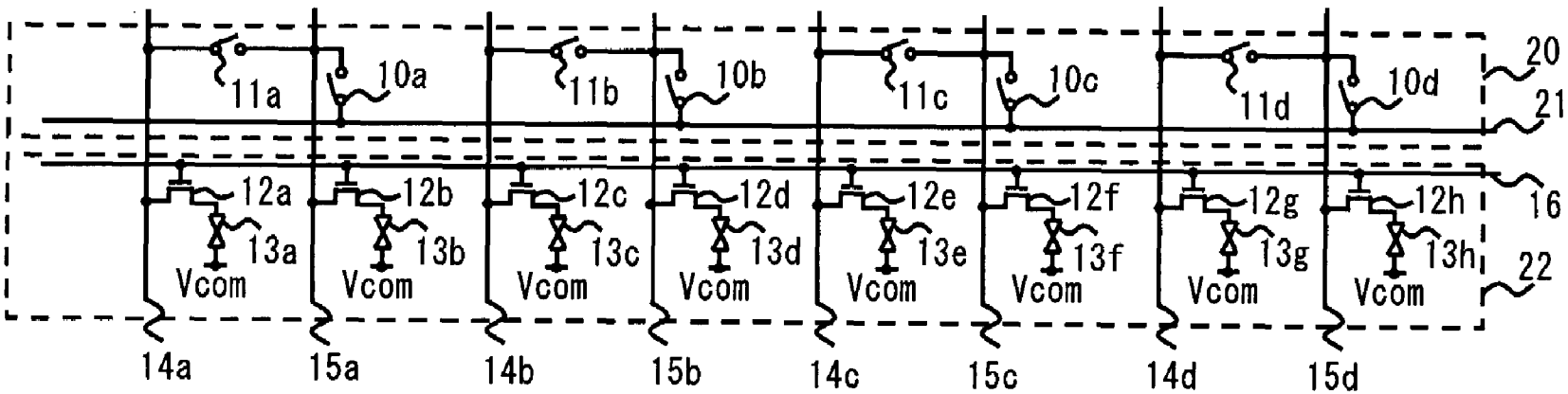
FIG. 7 shows another structure of the data line driving circuit according to the present invention.

Incidentally, the arrangement of the common node-connected switches 10 of the output short-circuit unit 20 in the data line driving circuit 25 is not limited to the above example. The common node-connected switches 10 can be connected to either one of the even-numbered data line 14 and odd-numbered data line 15 which are paired. FIGS. 6 and 7 show another arrangement of the common node-connected switches 10 of the data line driving circuit. For example, as shown in FIG. 6, one ends of the common node-connected switches 10*a* to 10*d* may be connected to the odd-numbered data lines 14*a* to 14*d*, and the other ends may be connected to the common node 21. Alternatively, as shown in FIG. 7, one ends of the common node-connected switches 10*a* to 10*d* may be connected with the even-numbered data lines 15*a* to 15*d*, and the other ends may be connected with the common node 21. Incidentally, the other components of FIGS. 6 and 7 may be structured like these of the first or second embodiment.

Figure 8:
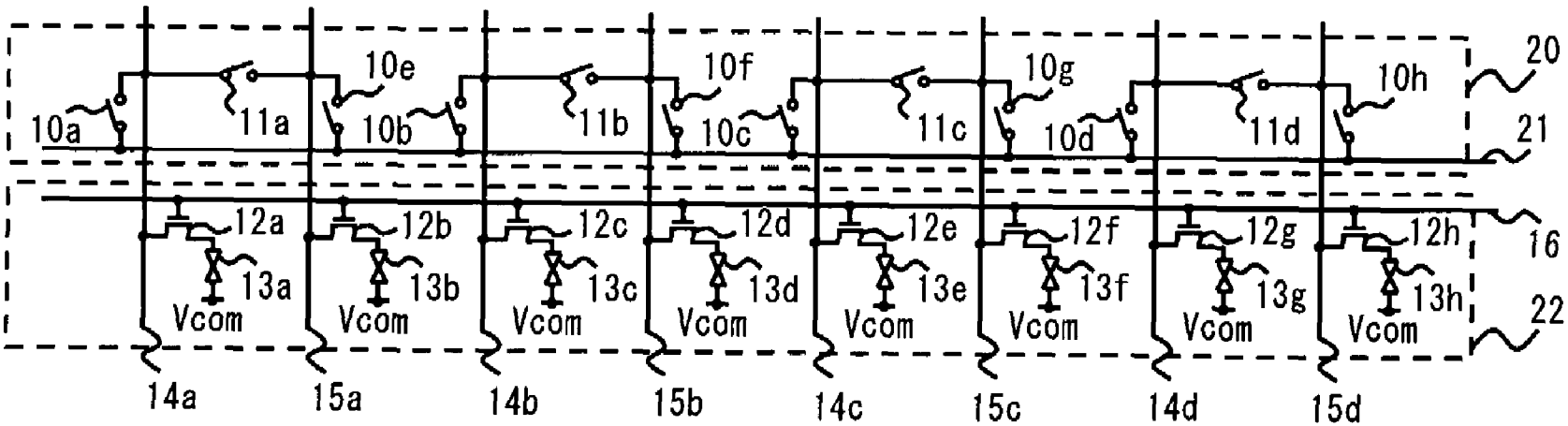
FIG. 8 shows another structure of the data line driving circuit according to the present invention.

Further, the common node-connected switches 10 of the output short-circuit unit 20 of the data line driving circuit 25 may be structured as shown in FIG. 8. FIG. 8 shows another arrangement of the common node-connected switches 10 of the data line driving circuit. As shown in FIG. 8, the common node-connected switches 10 of the output short-circuit unit 20 in the data line driving circuit 25 may be provided to the even-numbered data lines 14 and the odd-numbered data lines 15 which are paired. That is, the common node-connected switches 10 may be provided for plural data lines, not for data line pairs in a one-to-one correspondence. Accordingly, the plural data lines are connected with the common node 21 by the common node-connected switches 10*a* to 10*h*. Hence, in the data line pairs the voltage values are averaged to around the intermediate level (voltage Vcom) by the short-circuit switch 11, at the time of balancing the voltages that vary depending on the line pair, the voltage values of the data line pair can be averaged through two common node-connected switches 10 provided for the odd-numbered data lines 14 and the even-numbered data lines 15 that are paired. Therefore, it is possible to enhance the speed of averaging the voltage values of the data line pairs.

In this case, the common node-connected switches 10*a* to 10*h* produce similar beneficial effects even with a size that is ½ of the size of the aforementioned common node-connected switches that are provided for the data line pairs in one-to-one correspondence. Incidentally, the other components of FIG. 8 may be structured like these of the first or second embodiment.

Further, the above embodiment describes the dot-inversion driving, and a polarity of the gray-scale voltage is inverted between the odd-numbered data lines 14 and the even-numbered data lines, so the short-circuit switches 11 are provided for the pairs of the odd-numbered data lines 14 and the even-numbered data lines 15. However, the present invention is not limited thereto. For example, in the case of inverting the polarity every two lines (two data lines), in addition to the structure of short-circuiting adjacent data lines by use of the short-circuit switch, the short-circuit switches 11 may be provided for each pair of odd-numbered lines or each pair of even-numbered lines. That is, the short-circuit switches 11 are provided for each pair of data lines applied with gray-scale voltages opposite in polarity.

Further, the data lines to be short-circuited are not necessarily limited to the gray-scale voltages opposite in polarity. For example, two data lines of a positive polarity and two data lines of a negative polarity may be short-circuited, and one common node-connected switch may be provided for the four data lines. However, the time constant increases as the number of short-circuit switches increases, so there is a fear that it takes much time to set the voltage to the intermediate level. Accordingly, it is preferable to provide each pair of data lines opposite in polarity with the short-circuit switch 11.

Further, the structure of the liquid crystal panel 22 is not limited thereto. For example, the present invention is applicable to various other liquid crystal panels or display devices based on an IPS (In Plane Switching) method or the like.

As set forth above, the short-circuit occurs every pair of data lines (upon every polarity inversion), and the common node is connected to every data line pair, making it possible to average voltage values of the data lines to an intermediate level without using an external capacitor. Further, if MOS transistors are used, an area of the short-circuit switch and the common node-connected switch can be reduced to ½ of the original one. Further, in the case of structuring the switches using the transistor, it is possible to further save power consumption and suppress heat generation. In addition, it is possible to prevent deterioration of display characteristics such as a variation of the brightness.

It is apparent that the present invention is not limited to the above embodiment that may be modified and changed without departing from the scope and spirit of the invention.

What is claimed is:

1. A driving circuit for inversion-driving a display panel having a plurality of data lines that supply a gray-scale voltage, the driving circuit comprising:

a changeover switch for sequentially switching between a first operation of applying a positive gray-scale voltage to a first data line group and applying a negative gray-scale voltage to a second data line group and a second operation of applying a negative gray-scale voltage to the first data line group and applying a positive gray-scale voltage to the second data line group;

a plurality of short-circuit switches for short-circuiting data line of the first data line group and data line of the second data line group to produce a plurality of short-circuited data line groups in a switching period between the first operation and the second operation; and a plurality of common node-connected switches corresponding to the plurality of data line groups and short-circuiting a corresponding one of the data line groups to a common node.

2. The driving circuit according to claim 1, wherein the plurality of short-circuit switches are provided for a data line pair inclusive of one data line of the first data line group and one data line of the second data line group.

3. The driving circuit according to claim 1, wherein the plurality of short-circuit switches are provided for each pair of adjacent data lines.

4. The driving circuit according to claim 1, wherein the common node is in a floating state.

5. The driving circuit according to claim 1, wherein the short-circuit switches and the common node-connected switches are MOS transistors, and the short-circuit switch and the common node-connected switch corresponding to each of the data line groups share a source region or a drain region.

6. The driving circuit according to claim 1, wherein the plurality of short-circuited data line groups are each connected to the common node by a corresponding one of the common node-connected switches.

7. The driving circuit according to claim 1, wherein the common node-connected switches correspond to the plurality of data lines, and the plurality of data lines are connected with the common node by a corresponding one of the common node-connected switches.

8. The driving circuit according to claim 1, wherein the short-circuit switches have a lower on-resistance than an on-resistance of the common node-connected switches.

9. A display device, comprising: a display panel including a plurality of scanning lines, a plurality of data lines, a plurality of pixels electrodes defined between the plurality of scanning lines and the plurality of data lines, and a common electrode opposite to the pixel electrodes; and the driving circuit according to claim 1.

10. The driving circuit according to claim 1, further including means for causing the plurality of common node-connected switches to short-circuit the data line groups to a common node at a timing later than when the plurality of short-circuit switches short-circuits the data lines in the switching period.

11. The driving circuit according to claim 1, further including means for causing the plurality of common node-connected switches to short-circuit the data line groups to a common node at a same timing when the plurality of short-circuit switches short-circuits the data lines in the switching period.

12. The driving circuit according to claim 1, wherein each of the plurality of short-circuited data line groups is connected to the common node without another short-circuited data line group.

13. A driving method for generating a positive gray-scale voltage and a negative gray-scale voltage relative to a reference voltage to inversion-drive a display panel, the driving method comprising:

periodically switching a voltage applied to a data line between the positive gray-scale voltage and the negative gray-scale voltage; short-circuiting a data line applied with the positive gray-scale voltage and a data line applied with the negative gray-scale voltage to produce a plurality of short-circuited data line groups prior to the switching of the voltage applied to the data line; and short-circuiting each of the short-circuited data line groups to a common node by use of common node-connected switches corresponding to the plurality of short-circuited data line groups.

14. The driving method according to claim 13, wherein adjacent data lines are paired and short-circuited to produce the plurality of short-circuited data line groups.

15. The driving method according to claim 13, wherein the plurality of short-circuited data line groups are each connected to the common node by a corresponding one of the common node-connected switches.

16. The driving method according to claim 13, wherein the plurality of data lines are each connected with the common node by use of the common node-connected switches corresponding to the plurality of data lines.

17. The driving method according to claim 13, wherein the plurality of common node-connected switches short-circuit the data line groups to a common node at a timing later than when the plurality of short-circuit switches short-circuits the data lines in the switching period.

18. The driving method according to claim 13, wherein the plurality of common node-connected switches short-circuit the data line groups to a common node at a same timing when the plurality of short-circuit switches short-circuits the data lines in the switching period.

19. The driving method according to claim 13, wherein each of the plurality of short-circuited data line groups is connected to the common node without another short-circuited data line group.

* * * * *